US012416440B2

(12) United States Patent
Spaulding et al.

(10) Patent No.: US 12,416,440 B2
(45) Date of Patent: Sep. 16, 2025

(54) PASSIVE REFRIGERATION SYSTEM USING CARBON DIOXIDE SNOW

(71) Applicant: CRYOLOGISTICS REFRIGERATION TECHNOLOGIES LTD., Victoria (CA)

(72) Inventors: Will Spaulding, Victoria (CA); Adrian Gunstone, Victoria (CA); Liam Welgan-Gunn, Victoria (CA); Eldad Alber, Victoria (CA); Nigel David, Victoria (CA)

(73) Assignee: CRYOLOGISTICS REFRIGERATION TECHNOLOGIES LTD., Victoria (CA)

( * ) Notice: Subject to any disclaimer, the term of this patent is extended or adjusted under 35 U.S.C. 154(b) by 0 days.

(21) Appl. No.: 17/593,545

(22) PCT Filed: Mar. 17, 2020

(86) PCT No.: PCT/CA2020/000035
§ 371 (c)(1),
(2) Date: Sep. 20, 2021

(87) PCT Pub. No.: WO2020/186337
PCT Pub. Date: Sep. 24, 2020

(65) Prior Publication Data

US 2022/0170684 A1 Jun. 2, 2022

Related U.S. Application Data

(60) Provisional application No. 62/821,289, filed on Mar. 20, 2019.

(51) Int. Cl.
*F25D 3/12* (2006.01)

(52) U.S. Cl.
CPC ..... *F25D 3/122* (2013.01)

(58) Field of Classification Search
CPC ..... F25D 3/122; F25D 3/125; F25D 3/14
See application file for complete search history.

(56) References Cited

U.S. PATENT DOCUMENTS 4,399,658 A 8/1983 Nielsen
7,293,570 B2 11/2007 Jackson
(Continued)

FOREIGN PATENT DOCUMENTS

EP 0631096 A1 * 12/1994 ..... F25D 3/125
EP 0834334 A1 4/1998
(Continued)

OTHER PUBLICATIONS

English language translation of EP0631096 to Gibot et al. (Year: 1994).*

(Continued)

*Primary Examiner* — Cassey D Bauer
(74) *Attorney, Agent, or Firm* — McCoy Russell LLP

(57) ABSTRACT

A passive refrigeration apparatus comprising: (i) a container defining a cargo space; (ii) a liquid carbon dioxide cylinder; (iii) a control valve, in fluid communication with the cylinder; (iv) a controller for activating the control valve to control the flow of liquid CO2; and (v) a heat transfer assembly within the container, in fluid communication with the control valve; wherein the heat transfer assembly has (a) an expansion section for receiving the flow of liquid CO2; and (b) an expansion chamber bounded by a heat transfer surface in thermal contact with the cargo space; wherein the expansion section allows the vaporization of the liquid CO2 into the expansion chamber to create a mixture of carbon dioxide snow and CO2, thereby cooling the cargo space via the heat transfer surface.

17 Claims, 11 Drawing Sheets

(56) References Cited

U.S. PATENT DOCUMENTS

| | | | |
|---|---|---|---|
| 9,976,782 | B1 | 5/2018 | Holzwanger et al. |
| 2018/0010839 | A1 | 1/2018 | Zhou et al. |

FOREIGN PATENT DOCUMENTS

| | | | |
|---|---|---|---|
| EP | 0854334 | A1 | 7/1998 |
| EP | 0942244 | A1 | 9/1999 |
| EP | 3246642 | A1 | 11/2017 |
| EP | 3290833 | A1 | 3/2018 |
| WO | 2011076701 | A1 | 6/2011 |

OTHER PUBLICATIONS

ISA Canadian Intellectual Property Office, International Search Report Issued in Application No. PCT/CA2020/000035, Jun. 5, 2020, WIPO, 3 pages.

International Bureau of WIPO, International Preliminary Report on Patentability Issued in Application No. PCT/CA2020/000035, Dec. 16, 2020, WIPO, 30 pages.

* cited by examiner

PASSIVE REFRIGERATION SYSTEM USING CARBON DIOXIDE SNOW

CROSS REFERENCE TO RELATED APPLICATIONS

The present application is a U.S. National Phase of International Application No. PCT/CA2020/000035 entitled "PASSIVE REFRIGERATION SYSTEM USING CARBON DIOXIDE SNOW," and filed on Mar. 17, 2020. International Application No. PCT/CA2020/000035 claims priority to U.S. Patent Application No. 62/821,289 filed on Mar. 20, 2019. The entire contents of each of the above-listed applications are hereby incorporated by reference for all purposes.

TECHNICAL FIELD

The present disclosure relates to the field of passive refrigeration systems, for use in refrigerating perishable products during shipping and storage. More specifically, the present disclosure is directed to a heat exchange system that enables the use of liquid $CO_2$ to cool a cargo space with a high degree of temperature regulation without flooding the cargo space itself with the $CO_2$. The system may, for example, be used for pallet-size loads of refrigerated or frozen products, for small package-size loads, or for larger loads.

BACKGROUND AND SUMMARY

The cold chain industry is responsible for shipping and storing refrigerated temperature-sensitive products, such as food and pharmaceuticals. In this connection, so-called passive refrigeration systems are sometimes used, which have the advantage that they do not use electrical power as the primary means to generate the cooling effect and hence do not generally require a separate electrical power source. Dry ice (solid carbon dioxide or $CO_2$) is often used in specially designed and insulated containers of various sizes to keep the temperature cold inside the containers. It is difficult, however, to control the temperature of the product accurately with dry ice because the sublimation rate cannot easily be controlled. Further, the product arrives at destination, a dry ice system cannot be turned off, which often leads to wasted dry ice. The present disclosure seeks to address these problems with a novel heat transfer mechanism that enables the use of liquid $CO_2$ instead of dry ice. The present disclosure discloses a mechanism to convert liquid $CO_2$ (stored on board a refrigerated container) to low temperature carbon dioxide snow and gas that can be used in the refrigeration of an insulated container, but without injecting the $CO_2$ directly inside the refrigerated container.

U.S. Pat. No. 4,399,658 discloses a system for producing refrigeration from a source of liquid carbon dioxide. The liquid carbon dioxide is injected through a nozzle into a primary stream within an elongated enclosure. The enclosure is mounted with its inlet end spaced about the nozzle to define an opening through which an annular stream of ambient gas is directed about the primary stream. The ambient gas turbulently intermixes with the injected coolant for subliming any solid carbon dioxide or snow so that the resulting stream exhausting from the enclosure is free of snow. In that system, the $CO_2$ is injected directly inside the cargo space, resulting ultimately in very high concentrations of $CO_2$ inside the load space that can be damageable to certain food products.

European Application EP 3 246 642 A1 discloses a cryogenic reservoir for an insulated and refrigerated container. In the disclosure, liquid $CO_2$ is injected into the cryogenic reservoir (using a mechanism not included in the disclosure) where carbon dioxide snow accumulates, and where cold carbon dioxide gas is re-directed to a venting system external to the container. To avoid the snow to be returned to the venting system, a filtration system is employed. The disclosure includes features to provide good snow distribution and uniformity, such as deflecting plates and the utilization of two nozzles injecting against each other to reduce the strength of each jet and avoid undesired impingement on the filter. In this disclosure, once the snow is loaded, there is no longer any active control method of the temperature within the container, and the carbon dioxide resulting from the sublimation of the snow is released within the refrigerated container.

European Patent Application EP 3 290 833 A1 discloses a refrigerated container containing dry ice reservoirs that can be supplemented during certain transport segments by being connected to a liquid $CO_2$ source. The liquid $CO_2$ source provides cold gas directly to the inside of the refrigerated container as an alternative to or in supplement to dry ice within the refrigerated container. In this disclosure, the carbon dioxide is also directed directly to the inside of the container.

Some applications describe the desired formation of carbon dioxide snow. U.S. Pat. No. 7,293,570 describes a system to produce carbon dioxide snow to be used in the cleaning of machining operations. The disclosure teaches an apparatus comprised of sequential sections of increasing diameter section of pipes that favor the formation of increasing sizes of carbon dioxide snow. While this disclosure discloses a method of generating snow, it does not disclose a method of benefitting from the cooling potential of this snow as way to remove heat from a load space.

European Patent Application EP 0 834 334 A1 discloses a tray for receiving of $CO_2$ snow comprising an injection means with an injector connected to a source of liquid $CO_2$. The design permits the injection of carbon dioxide snow into the tray, and, via the top front of the tray, discharge of the $CO_2$ gas formed during the injection. The device creates within the tray compartment a single large swirl of gaseous $CO_2$ mixed with dry ice particles, and does not disclose any features to create a turbulent mixing environment within the chamber to facilitate the formation, accumulation and sublimation of $CO_2$ snow.

European Patent Application EP 0 942 244 A1 also discloses an apparatus and method to create and accumulate $CO_2$ snow formed by the injection of liquid $CO_2$ into a compartment. The apparatus uses a $CO_2$ injection tube with a porous mesh screen to separate the $CO_2$ gas from the solid particles of dry ice snow, and as in the prior art described above, does not disclose any features to create a turbulent mixing environment within the compartment to facilitate the formation, accumulation and sublimation of $CO_2$ snow.

U.S. Pat. No. 9,976,782 B1 discloses an apparatus and method to expand liquid $CO_2$ through a network of capillary tubes without the creation or accumulation of dry ice, for the purpose of cooling items that require a controlled temperature environment. The disclosure specifically seeks to avoid the creation of dry ice snow within the cooling capillaries, and does not disclose any means whereby turbulent flow is deliberately created to encourage the formation of $CO_2$ snow.

Typical dry ice cooled containers have no control over the temperature of the load, and cannot be "turned off", resulting in wastage of $CO_2$. This problem has been addressed herein by using liquid $CO_2$ instead of dry ice on-board the refrigerated container. Liquid $CO_2$ (sometimes referred to herein as "$LCO_2$") exists at room temperature if it is kept at high pressures, typically near 55 bar, but as high as 70 bar, in suitable cylinders. When the liquid $CO_2$ is expanded to a pressure below 5 bar, it forms a mixture of cold gas and carbon dioxide snow at temperatures between −56.5° C. and −78.5° C. A suitable heat transfer mechanism is needed to most advantageously make use of this cold snow and gas that: (i) provides a uniform temperature within the cargo space; (ii) is controllable such that it can be turned on and off and can be set to maintain a selectable target temperature; and iii) does not release the $CO_2$ into the cargo space, thus protecting the contents from the potential damage due to high $CO_2$ concentration atmosphere. Furthermore it is desirable that: (i) the system should be as small as possible to maximize the load carrying capability and to minimize the footprint and weight of the container; (ii) the system should be able to operate even if a load comes in contact with the heat transfer system; and (iii) the system does not absolutely require fans, so as to reduce the system's size and power consumption.

The disclosed novel heat transfer mechanism consists of a $LCO_2$ expansion chamber whose main walls form a heat transfer surface suitably located in the container to be cooled. A certain location would be near the top of the cargo space such as to generate a strong natural convection air flow within the cargo space. A control valve allows the timing and duration of $LCO_2$ injection into the expansion chamber in response to at least one measured temperature within the cargo space and an adjustable target temperature. The $LCO_2$ expansion chamber is configured to maximize the generation of carbon dioxide snow and to distribute such snow as uniformly as possible so as to have as uniform a heat transfer surface temperature as possible. The expansion chamber is further configured to capture and direct the cold gas to contribute to the cooling of the heat transfer surface. The heat transfer mechanism includes an exhaust system for the gas resulting from the expansion of the $LCO_2$ and from the sublimation of the solid $CO_2$ to further contribute to the cooling of the container before being exhausted outside of the container.

In accordance with an aspect of the present disclosure, disclosed herein is a passive refrigeration apparatus for controlled refrigeration of a product, the refrigeration apparatus comprising: (i) an insulated container, the container defining a cargo space for receiving a load; (ii) one or more cylinders for supplying a flow of liquid carbon dioxide ($CO_2$); (iii) a control valve, in fluid communication with the cylinder, via a fluid pipe; (iv) a controller, adapted to activate and deactivate the control valve, to control the flow of liquid $CO_2$; (v) a heat transfer assembly, disposed within the container, and in fluid communication with the control valve; and (vi) an exhaust fluid line in fluid communication with the heat transfer assembly; wherein the heat transfer assembly comprises; (a) an expansion section, in fluid communication with the control valve, and for receiving the flow of liquid $CO_2$; and (b) an expansion chamber, the expansion chamber bounded by a heat transfer surface, the heat transfer surface in thermal contact with the cargo space; wherein the expansion section is adapted to allow the vaporization of the liquid $CO_2$ into the expansion chamber to create a mixture of carbon dioxide snow and $CO_2$ gas within the expansion chamber, thereby cooling the cargo space via the heat transfer surface, and wherein $CO_2$ gas may be exhausted through the exhaust fluid line; and wherein the heat transfer assembly additionally comprises at least one bluff body, disposed within the expansion chamber and proximate to the expansion section, wherein the at least one bluff body facilitates generation of turbulence within the expansion chamber, in order to facilitate creation and accumulation of carbon dioxide snow.

In accordance with another aspect, the passive refrigeration apparatus includes a temperature sensor located within the cargo space for measuring the temperature thereof, and in communication with the controller, to allow the controller to control the cooling in accordance with the measured temperature and/or with reference to a desired target temperature.

In another aspect, the heat transfer assembly is provided with a filter for preventing carbon dioxide snow from entering the exhaust fluid line. In another aspect, the heat transfer assembly is configured with one or more ridges disposed within the expansion chamber to facilitate the accumulation of carbon dioxide snow within the expansion chamber. In another aspect, the heat transfer assembly may be provided with a mesh or matrix structure disposed within the expansion chamber, to facilitate the accumulation of carbon dioxide snow within the expansion chamber.

In another aspect, the passive refrigeration apparatus is provided with a door opening, and may be adapted to receive one or more standard pallet-sized loads.

In another aspect, the refrigeration apparatus may be provided with an exhaust manifold between the heat transfer assembly and the exhaust fluid line, that permits passage of the $CO_2$ gas therethrough, and which is also in thermal contact with the cargo space, thereby also facilitating the cooling of the cargo space. In one aspect, the exhaust manifold may be in the form of one or more pipes, arranged in a generally serpentine configuration.

In another aspect, the heat transfer assembly may be provided with a plurality of convective fins for facilitating heat transfer between the cargo space and the heat transfer assembly. In another aspect, the heat transfer assembly is generally disposed in an upper portion of the cargo space. In another aspect, the passive refrigeration apparatus may be provided with a protective barrier within the cargo space for preventing the load from coming in to contact with the heat transfer assembly.

In some embodiments, the passive refrigeration apparatus may comprise a plurality of the heat transfer assemblies connected to one or more control valves.

Also disclosed herein is a method of passive refrigeration involving any of the passive refrigeration apparatuses disclosed herein.

DETAILED DESCRIPTION

Figure 1:
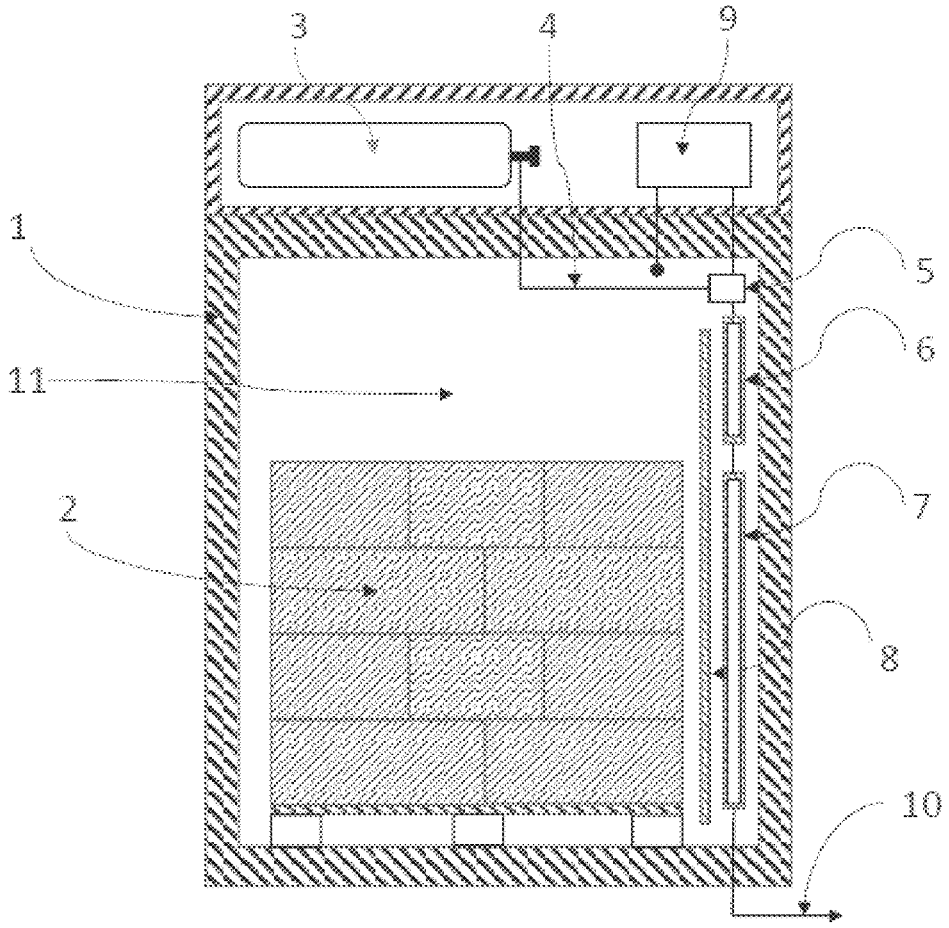
FIG. 1 is a cross-sectional front view of an exemplary schematic representation of a refrigeration system in accordance with an aspect of the present disclosure.

A detailed description of one or more embodiments of the present disclosure is provided below along with accompanying figures that illustrate the principles of the disclosure. As such, this detailed description illustrates the present disclosure by way of example and not by way of limitation. The description will clearly enable one skilled in the art to make and use the disclosure, and describes several embodiments, adaptations, variations and alternatives and uses of the disclosure, including what is presently believed to be the best mode and certain embodiment for carrying out the disclosure. It is to be understood that routine variations and adaptations can be made to the disclosure as described, and such variations and adaptations squarely fall within the spirit and scope of the disclosure. For the purpose of clarity, technical material that is known in the technical fields related to the disclosure has not been described in detail so that the disclosure is not unnecessarily obscured.

Except as otherwise expressly provided, the following rules of interpretation apply to this specification (written description, claims and drawings): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "herein before", and "hereinafter", and words of similar import, refer to this specification in its entirety and not to any certain paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

The term "computer" can refer to any apparatus that is capable of accepting a structured input, processing the structured input according to prescribed rules, and producing results of the processing as output. Examples of a computer include: a computer; a general purpose computer; a desktop computer, a network computer, a laptop computer; a computer on a smartphone or other portable device, a supercomputer; a mainframe; a super mini-computer; a mini-computer; a workstation; a micro-computer; a server; an interactive television; a hybrid combination of a computer and an interactive television; and application-specific hardware to emulate a computer and/or software. A computer can have a single processor or multiple processors, which can operate in parallel and/or not in parallel. A computer also refers to two or more computers connected together via a network for transmitting or receiving information between the computers. An example of such a computer includes a distributed computer system for processing information via computers linked by a network. The techniques described herein may be implemented by one or more special-purpose computers, which may be hard-wired to perform the techniques, or which may include digital electronic devices such as one or more application-specific integrated circuits (ASICs) or field programmable gate arrays (FPGAs) that are persistently programmed to perform the techniques, or which may include one or more general purpose hardware processors programmed to perform the techniques pursuant to program instructions in firmware, memory, other storage, or a combination. Such special-purpose computers may also combine custom hard-wired logic, ASICs, or FPGAs with custom programming to accomplish the techniques.

The term a "computer system" may refer to a system having a computer, where the computer comprises a computer-readable medium embodying software to operate the computer.

The term "computer-readable medium" may refer to any storage device used for storing data accessible by a computer, as well as any other means for providing access to data by a computer. Examples of a storage-device-type computer-readable medium include: a magnetic hard disk; a solid state drive; a floppy disk; an optical disk, such as a CD-ROM and a DVD; a magnetic tape; or a memory chip.

The term "software" can refer to prescribed rules to operate a computer. Examples of software include: software; code segments; instructions; computer programs; and programmed logic.

In accordance with one aspect of the present disclosure, FIG. 1 illustrates a cross-sectional view of an insulated container 1 in which a load 2 can be located and loaded through a door (not shown). The insulated container comprises at least one cylinder 3 of liquid $CO_2$, which can be located outside the insulated load space or cargo space 11. (The cylinder 3 is generally referred to herein as a "cylinder", although it should be understood that this is intended to refer to any container for and/or source of liquid $CO_2$.) The cylinder 3 is connected through a fluid pipe 4 to a control valve 5. Within the insulated container 1 is at least one heat transfer assembly 6 within which is located an expansion chamber which is in fluid connection with the control valve 5. When the control valve 5 is opened by a command signal from controller 9, liquid carbon dioxide is injected into the heat transfer assembly 6 (described further below) which is configured to produce cold carbon dioxide snow and gas. The cold snow and gas make the heat transfer assembly 6 very cold—at temperatures as low as −78.5° C. The very low temperature on the surfaces of the heat transfer assembly 6 cools the air near it. As this air cools below the air temperature in the cargo space 11, it becomes heavier/denser and sinks down towards the bottom of the cargo space 11. Warmer air from nearer the top of the cargo space 11 flows towards the heat transfer assembly 6 to replace the sinking colder air, establishing a natural convective flow within the cargo space 11. Cold carbon dioxide is then exhausted to at least one exhaust manifold 7 which further cools the surrounding air in the cargo space 11. The exhaust manifold 7 can be located in different areas of the insulated container 1 as will be described further below. The carbon dioxide is then exhausted to outside of the insulated container 1 through an exhaust fluid line 10. Optionally, the exhaust carbon dioxide can be routed to a vent line connected to the outside of a cargo or storage area to minimize carbon dioxide accumulation outside the insulated container. A barrier 8 is located between the load 2 and the wall below the heat transfer assembly 6 to prevent a shift in the load 2 blocking the convective air flow.

Figure 2B:
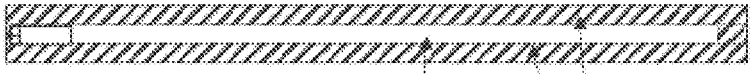
FIG. 2B is a cross-sectional plan view of the heat transfer assembly of FIG. 2A.
Figure 2A:
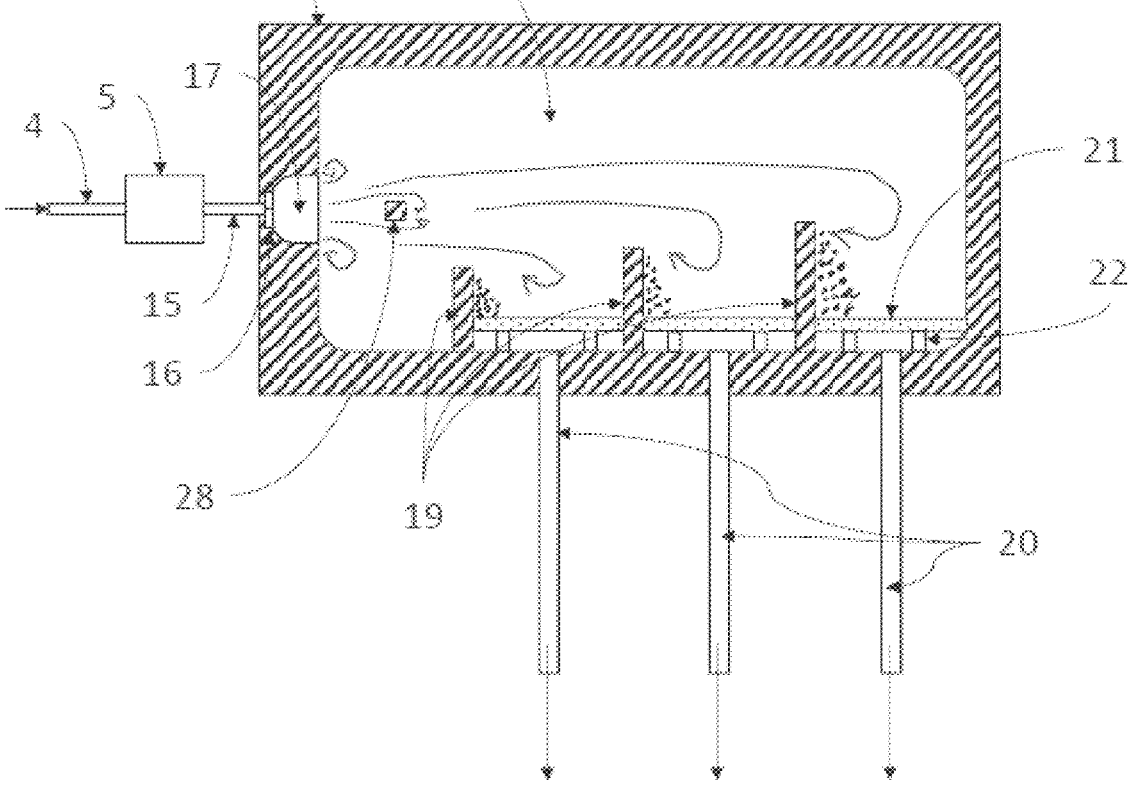
FIG. 2A is a cross-sectional side view of an exemplary representation of a heat transfer assembly.

FIG. 2A shows a cross-sectional view of a configuration of the heat transfer assembly 6. The heat transfer assembly 6 has an expansion chamber 18 which is in fluid connection with a supply of liquid $CO_2$ through fluid pipe 4, control valve 5, supply line 15, orifice 16 and expansion section 17 (diffuser). When the control valve 5 is opened, liquid $CO_2$ flows through the orifice 16. The cross-sectional areas of the expansion section 17 and of the expansion chamber 18 are such that the pressure of the carbon dioxide drops from a level between 20 and 70 bar down to pressure below 5 bar. To ensure that the pressure drops sufficiently in the expansion chamber 18, the cross-sectional area of expansion chamber 18 must be sufficient to enable the liquid $CO_2$ to expand from a density which can be as high as 1075 kg/m$^3$ to a gas with a density as low as 2.5 kg/m$^3$. Thermodynamically, the pressure must drop below 5.2 bar to yield snow. At such pressure, the $CO_2$ gas density is 13.2 kg/m$^3$. This means the ratio of the cross sectional of the chamber to that of the nozzle must be at least 82, but may be greater than 434.

The conversion from compressed liquid $CO_2$, upstream of orifice 16, to solid $CO_2$ (dry ice) and gaseous $CO_2$ in expansion chamber 18, is a multistage conversion process guided and enhanced by aspects of this disclosure.

As the liquid carbon dioxide goes from a high pressure between 20 and 70 bar ahead of orifice 16 to a larger cross-sectional area with a pressure below 5 bar, it reaches high axial velocity at the nozzle and significant radial velocities as it expands in section 17 and expansion chamber 18. As the pressure drops below 5.2 bar, the carbon dioxide is transformed from a liquid to a mixture of fine solid carbon dioxide and gas at a temperature below −56.5° C. For instance, within the expansion chamber 18, is located at least one turbulence generating feature, such as the exit edges of expansion section 17 or one or more bluff body 28. These features create a multitude of small turbulent vortices. The low-pressure cores of these vortices act to provide sites where $CO_2$ solid crystals form and start to agglomerate into larger snow particles. Larger particles continue to travel downstream and may further agglomerate into even larger particles as they collide together in the turbulent flow or on the upstream faces of bluff bodies farther downstream. Amalgamation into large multi-crystalline formations (sometimes referred to herein as "dry ice snow" or "carbon dioxide snow") is important as the crystals originally formed are so small that they could easily pass through the downstream accumulator filters 21 and leave the heat transfer assembly without the ability to absorb the heat that is key to the fundamental functioning of the present apparatus.

For instance, the present disclosure is provided with additional features that encourage the accumulation of solid carbon dioxide snow. FIG. 2A depicts at least one ridge 19 to create one or more accumulation zones for the solid carbon dioxide snow, but it is contemplated that other types of structures could be used. The ridges 19 can be arranged to minimize the chance of plugging, ensuring a larger unrestricted flow closer to the orifice 16. The configuration of the expansion chamber 18, the ridges 19 and filters 21 also serves to guide the flow and the dry ice snow into specific and optimal locations within the expansion chamber 18, with the aim to have as uniform a snow loading as possible so as to create a uniform low temperature surface within the cargo space 11.

The cold gas resulting from the expansion and from the sublimation of the carbon dioxide cools the walls 23 of the expansion chamber 18, before exiting into at least one exhaust pipe 20. To prevent carbon dioxide snow from flowing down the exhaust pipe 20, a filter 21 may be used between the expansion chamber 18 and the exhaust pipe or pipes 20. For instance, a filter support 22 may also be provided to help provide structural support to the filter 21, in order to maintain an "air" gap between the filter 21 and the opening of the exhaust pipes 20 for the cold gas to flow into the exhaust pipes 20.

Referring to FIG. 2B, the expansion chamber 18 is bounded by at least one heat transfer surface 23. The heat transfer surface 23 is cooled by the cold gas, by the carbon dioxide snow and by the sublimation of the carbon dioxide snow. The heat transfer surfaces 23, which may be made of a high conductivity material such as steel or aluminum, in turn cools the air in the cargo space 11. The expansion chamber 18 may be made of flat plates assembled together so as to keep a thin profile, minimizing the space needed by the heat transfer assembly 6 within the cargo space 11.

An important feature of the heat transfer assembly 6 is that its surface areas be sufficient to provide the necessary level of cooling to the container 1. The needed level of cooling is, at minimum, at a level sufficient to overcome to expected heat input into the container under the most challenging temperature conditions, say when the desired temperature inside is −30° C. and the external temperature is 40° C. In practice, the needed level of cooling is greater than that strictly needed to overcome the heat input because the cool down time must be sufficiently short, say of the order of 30 minutes or less. The surface area can be calculated simply by taking the needed level of cooling and a natural convective heat transfer coefficient.

Figure 3:
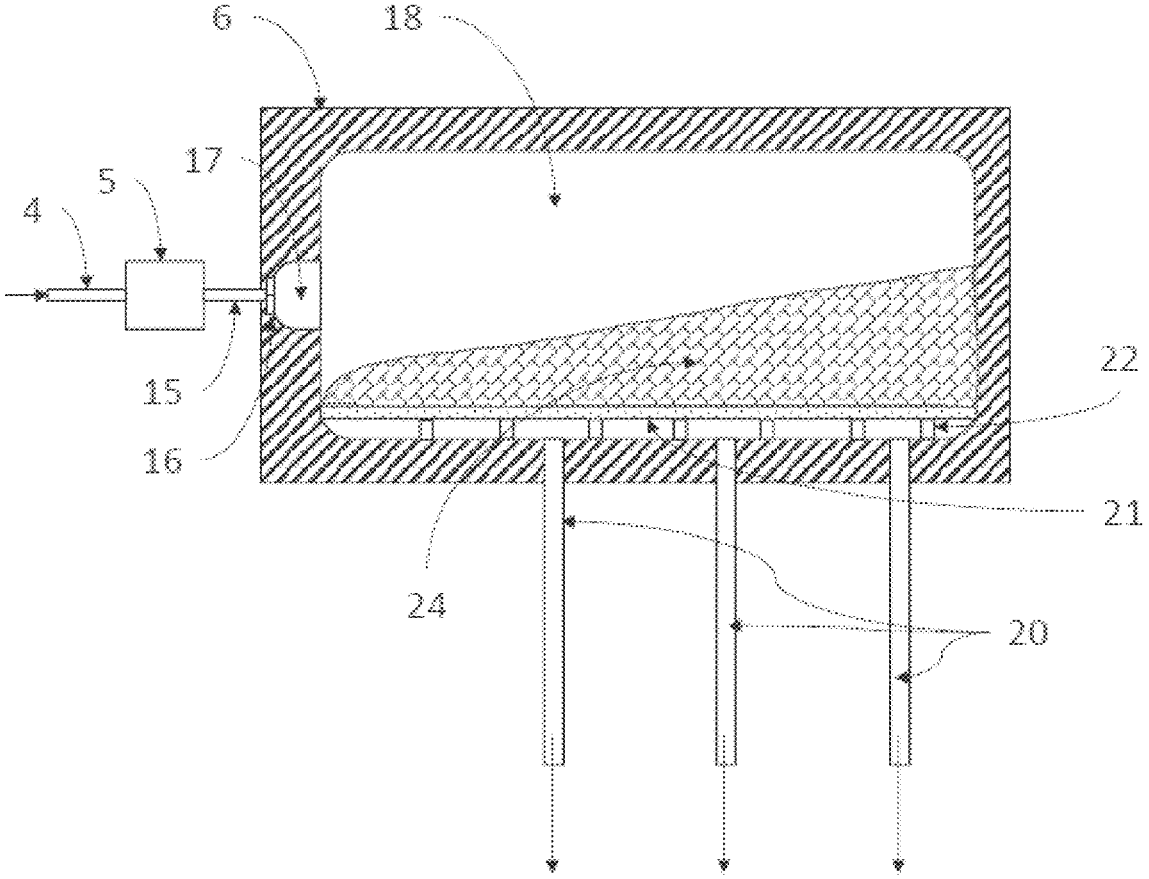
FIG. 3 is a cross-sectional side view illustrating an alternative embodiment of the heat transfer assembly.

In accordance with another aspect, as an alternative to ridges 19, the expansion chamber 18, as shown in FIG. 3, can contain one or more structures 24 made of a mesh (or matrix) suitable for low temperature operation and which are configured to create turbulence, and agglomeration and accumulation of carbon dioxide snow across the length of the expansion chamber 18. The mean dimension of the mesh cells may be of the order of between 1 mm and 10 mm. For instance, the mesh may be made of materials that maintain sufficient strength at very low temperatures and conduct heat well. An aluminum or steel wool or mesh may be an example of such material. Furthermore the structure 24 may be shaped to favor the axial distribution of carbon dioxide snow between the orifice 16 and the opposite wall of the expansion chamber 18.

Figure 4A:
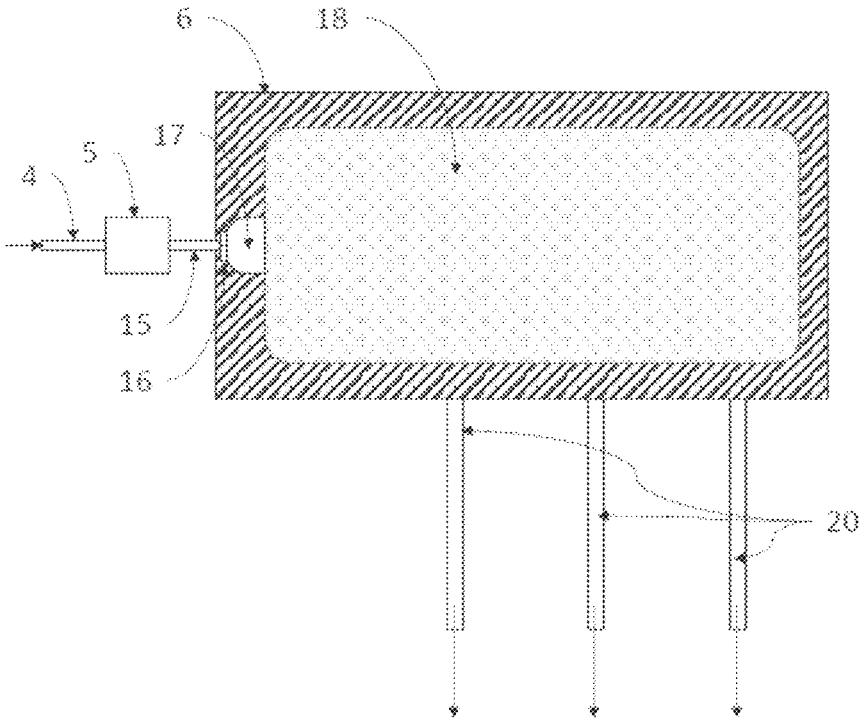
FIG. 4A is a cross-sectional side view illustrating an alternative embodiment of the heat transfer assembly.
Figure 4B:
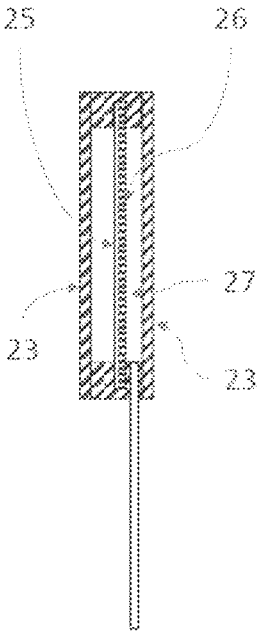
FIG. 4B is a cross-sectional side view of the heat transfer assembly of FIG. 4A.

Filter 21 serves to prevent the carbon dioxide snow from flowing directly to the exhaust 20, while not restricting the gas flow. The filter 21 may be selected to retain snow crystals that are, for example, 50 microns in diameter or greater. The filter 21 can be made of a material that retains sufficient strength at low temperature, such as polyester nylon or synthetic paper filter. Alternate locations and configurations of the filter 21 may be contemplated that achieve the same intent. FIGS. 4A and 4B show an arrangement where a filter 25 is located between the expansion chamber 18 and a gas exhaust manifold 27. The filter 25 is supported by a filter support 26. Both the expansion chamber 18 and the exhaust manifold 27 are bounded by a wall 23 with high thermal conductivity as described above. This configuration has the benefit of easier assembly and providing a larger filtration area and therefore potentially better snow distribution.

Figure 5:
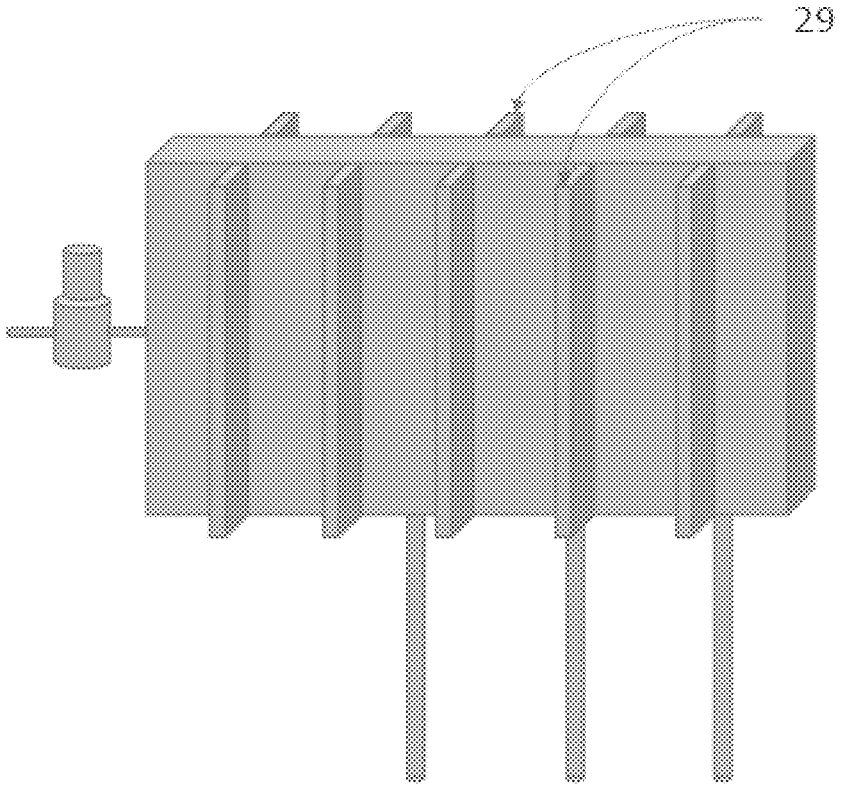
FIG. 5 is a perspective view of a heat transfer assembly in accordance with one aspect of the present disclosure.

In addition, the heat transfer surfaces 23 can be configured to have a plurality of convective fins 29 on one or both of the heat transfer surfaces 23 as illustrated in FIG. 5. Many other configurations of fins are conceivable to achieve the purpose of increasing the convective heat transfer while keeping the aspect ratio of the heat transfer assembly 6 relatively thin compared to the dimension of the container 1.

Figure 6B:
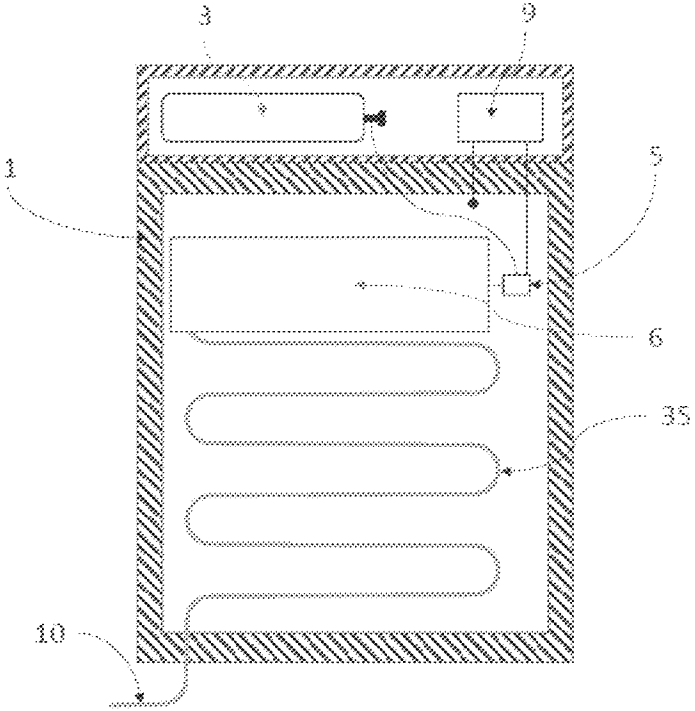
FIG. 6B is a cross-sectional front view illustrating in schematic form another possible configuration for the refrigeration system.
Figure 6A:
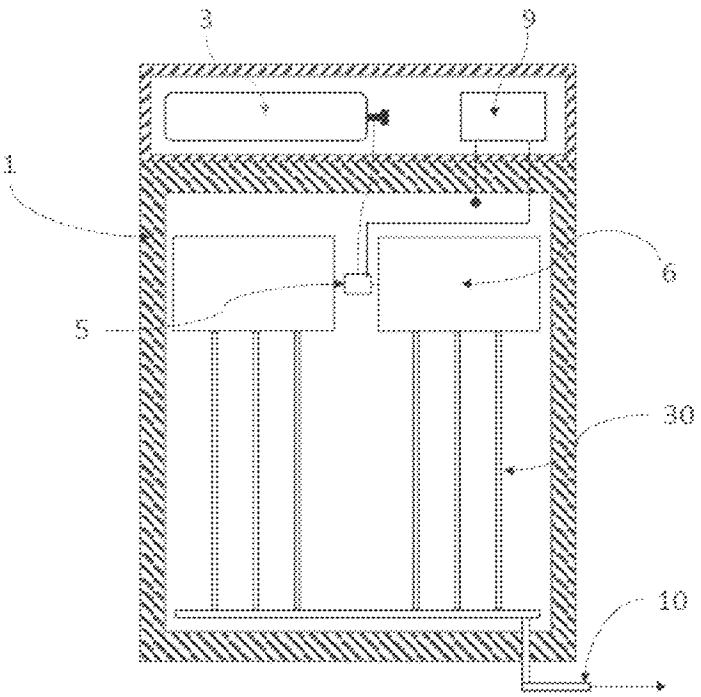
FIG. 6A is a cross-sectional front view illustrating in schematic form a possible configuration for the refrigeration system.

FIG. 6A shows another possible configuration of the heat transfer assembly 6 and exhaust. In this case, a single control valve 5 feeds two heat transfer assemblies 6. Each heat transfer assembly has at least one pipe 30 that brings the expansion gas to a lower manifold which is exhausted to the outside of the container 1 through exhaust line 10. Because the gas in the pipe 30 is still cold, it further cools the air within the cargo space 11. The container 1 may contain a heat transfer assembly 6 on one or more of the walls of the container 1.

It will be apparent to one skilled in the art that different configurations of and locations for the exhaust manifold are possible which achieve the same intent. FIG. 6B, for example, shows an alternate configuration in which the expanded gas exhaust is made of at least one serpentine 35 configuration typical of heat transfer systems.

Figure 6C:
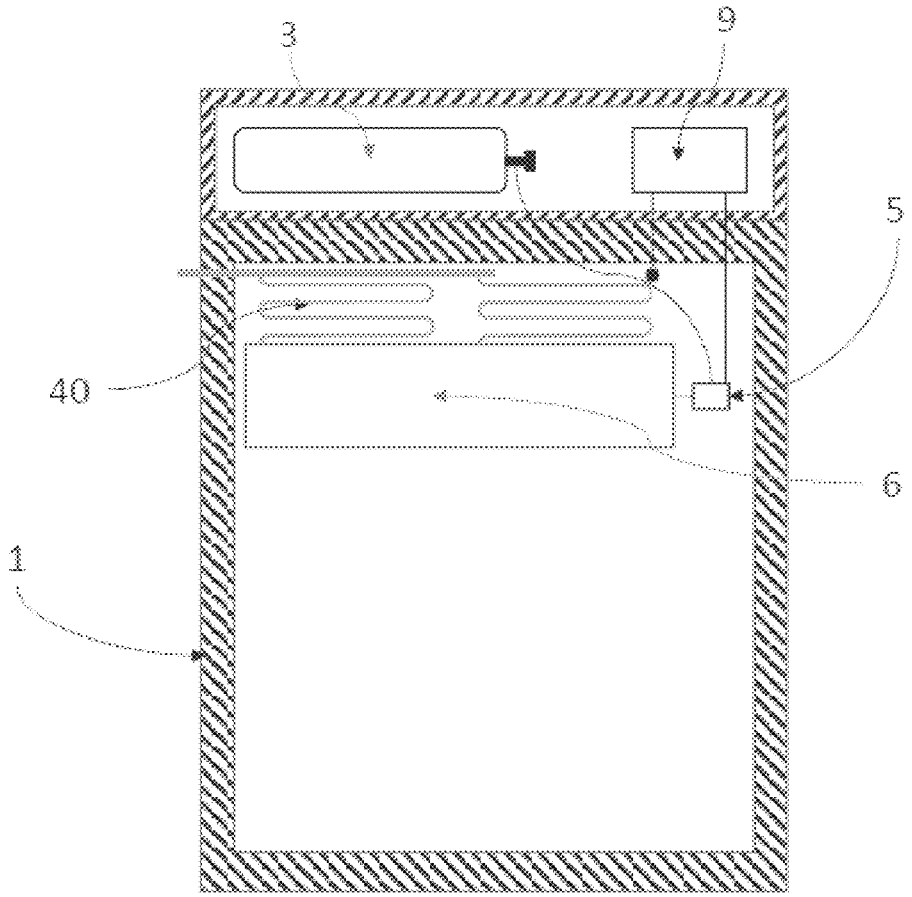
FIG. 6C is a cross-sectional front view illustrating in schematic form yet another possible configuration for the refrigeration system.

FIG. 6C shows another alternate configuration in which the expanded gas exhaust is located above the heat transfer assembly 6 so as to pre-cool the air being circulated by the convective flow before it comes into contact with the heat transfer assembly 6. The exhaust system may be composed of straight sections of pipes connected to a manifold, similar to that shown in FIG. 4A, but located above the heat transfer assembly 6. Alternatively, the exhaust system may comprise at least one serpentine piping assembly 40 as shown in FIG. 6C. It should be understood that when the exhaust system is located above the heat transfer assembly 6, it does not have to be vertical as shown, but may be placed horizontally, just below the ceiling of the container 1.

In any of the exhaust systems, such as those shown as examples in FIGS. 6A-6C, a low cracking pressure one-way valve can be located in the exhaust line 10 so as to ensure $CO_2$ can go out, but warm air and moisture do not come into the exhaust line 10 or into the heat transfer assembly 6. Warm air could increase heat transfer into the container, while moisture could lead to undesirable ice formation—all of which can affect the functioning and efficiency of the refrigeration system.

Figure 7B:
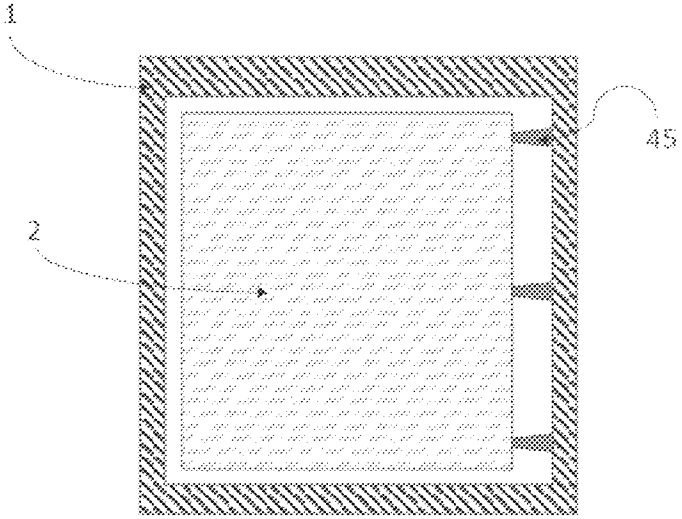
FIG. 7B is a cross-sectional side view illustrating an alternate barrier configuration in the cargo space.
Figure 7A:
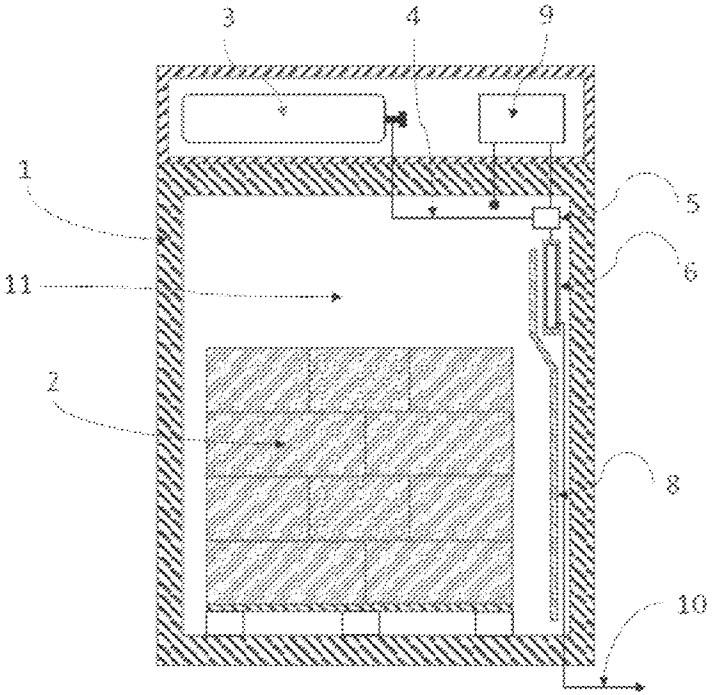
FIG. 7A is a cross-sectional front view illustrating in schematic form one embodiment of the refrigeration system.

FIG. 1 shows an optional possible configuration of a barrier 8. The barrier's purpose is to maintain a path for the cold air that comes into contact with the walls of the heat transfer assembly 6 to sink, even if the load shifts (e.g. during transit) towards the wall. The barrier 8 may be made of any material suitable for operation at freezing temperatures such as metals or selected plastics such as polycarbonate. For instance, the barrier 8 should be robust and/or rigid enough to keep the load away from the heat transfer assembly 6, yet relatively lightweight. The barrier 8 may be maintained in place with appropriate fixation methods to one or more of the walls, ceiling and floor. Barrier 8 may be made of a material that has low thermal conductivity, thus ensuring that the cold air flowing downwards from the heat transfer assembly remains as cold as possible through its downward travel. FIG. 7A shows an alternate configuration of the barrier 8 that minimizes the space taken by the barrier within the cargo space 11. Other methods can be conceived to achieve the same effect, including the use of a double-wall assembly affixed to the wall behind the heat transfer assembly 6 and in which the exhaust assembly or exhaust line 10 can be inserted. Spacers 45 could also be used to keep the load from contacting the wall, as illustrated in FIG. 7B. FIG. 7C shows another configuration where the barrier 8 directs most of the convective flow of colder air to go behind the heat transfer assembly 6 by reducing the heat transfer on the front wall using a suitable insulating material, and by blocking the passage between the front of the heat transfer assembly 6 and the space between the wall and the barrier.

While not specifically illustrated, it is also contemplated that in other embodiments, fans may be provided within the cargo space to facilitate the convective air flow within the cargo space, i.e. the downwards flow of the cooled, denser air near the heat transfer assembly, and the upward flow of the warmer air to replace the displaced cooled, denser air. These fans may be run continuously or intermittently, as required.

Figure 7D:
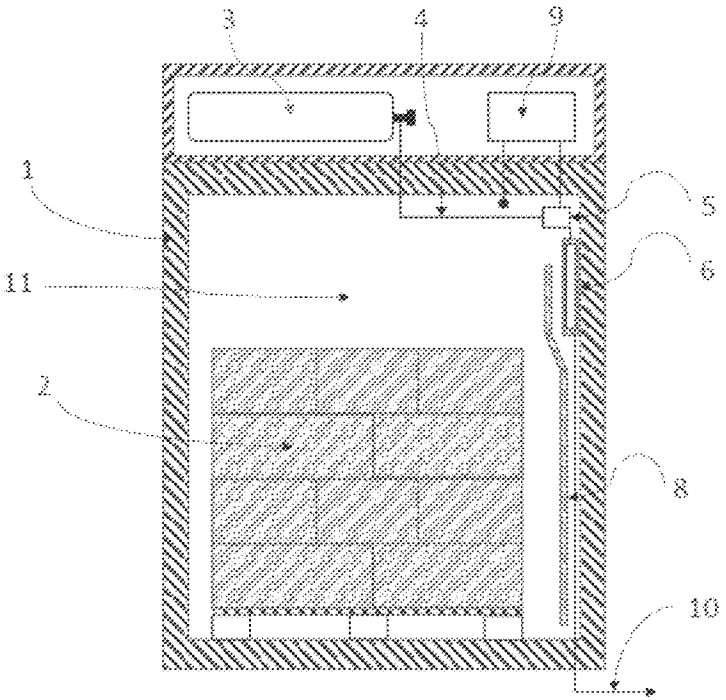
FIG. 7D is a cross-sectional front view of an embodiment of the refrigeration system, illustrating another configuration for the barrier and heat transfer assembly.
Figure 7C:
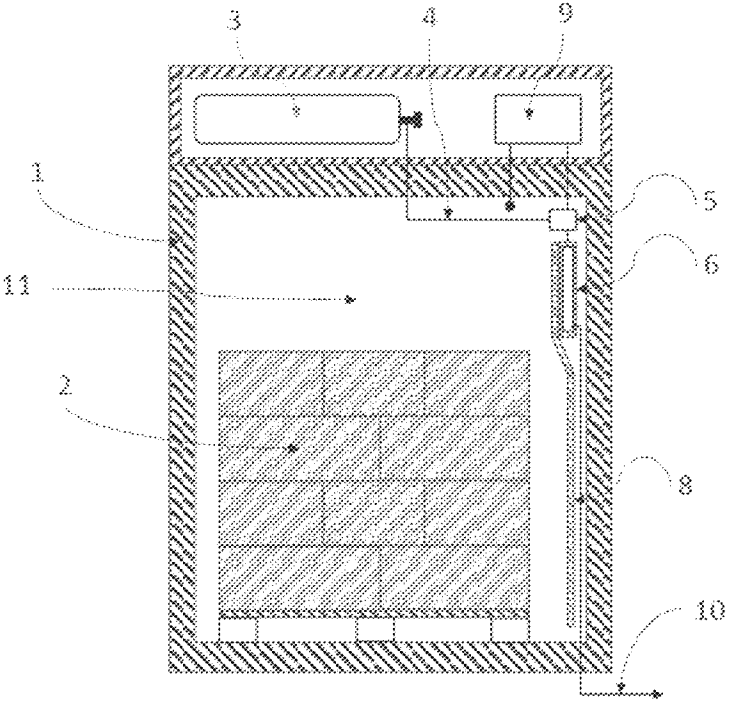
FIG. 7C is a cross-sectional front view of an embodiment of the refrigeration system, illustrating one configuration for the barrier and heat transfer assembly.

FIG. 7D shows a configuration where the heat transfer assembly 6 is mounted directly on the wall of the container 1 to minimize intrusion into the cargo space, and a barrier 8 that is configured so as to protect the convective flow.

Figure 7E:
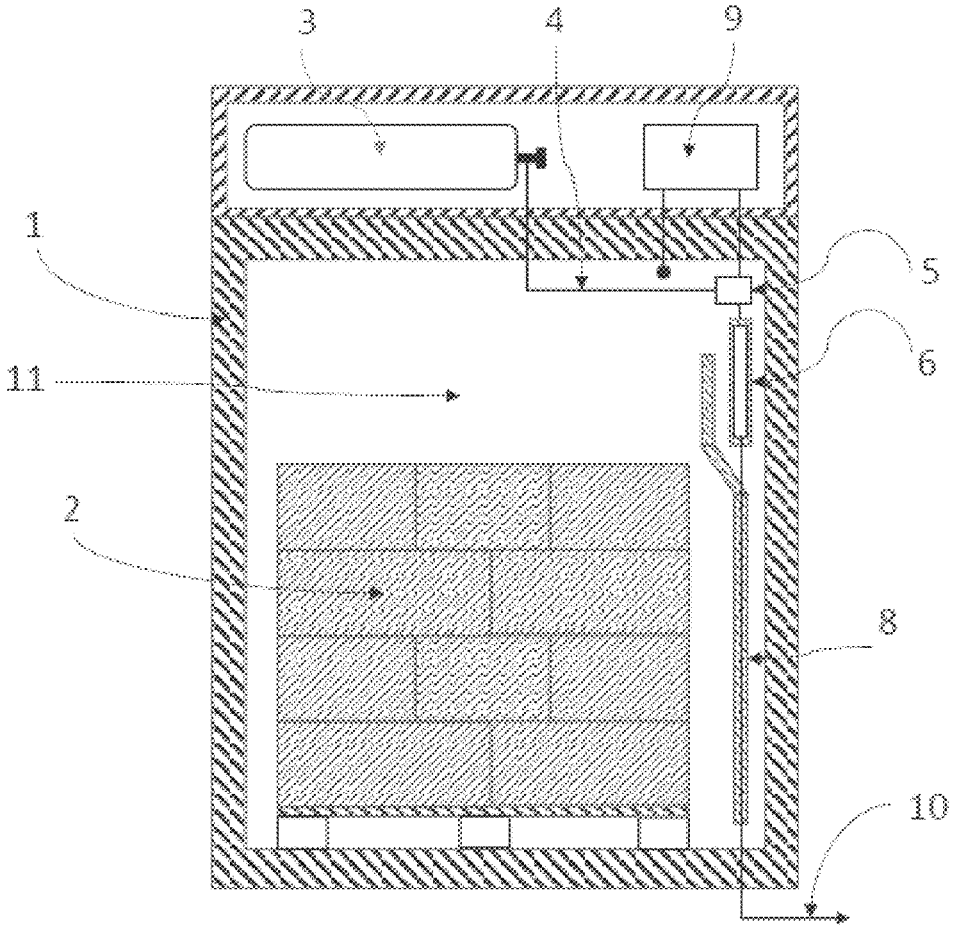
FIG. 7E is a cross-sectional front view of an embodiment of the refrigeration system, illustrating another configuration of the barrier and exhaust fluid line.

FIG. 7E shows a configuration where the exhaust fluid line 10 goes through the barrier 8. Such a configuration reduces the temperature of the barrier which helps keep the downward flowing cold gas from the barrier as cold as possible.

Figure 8:
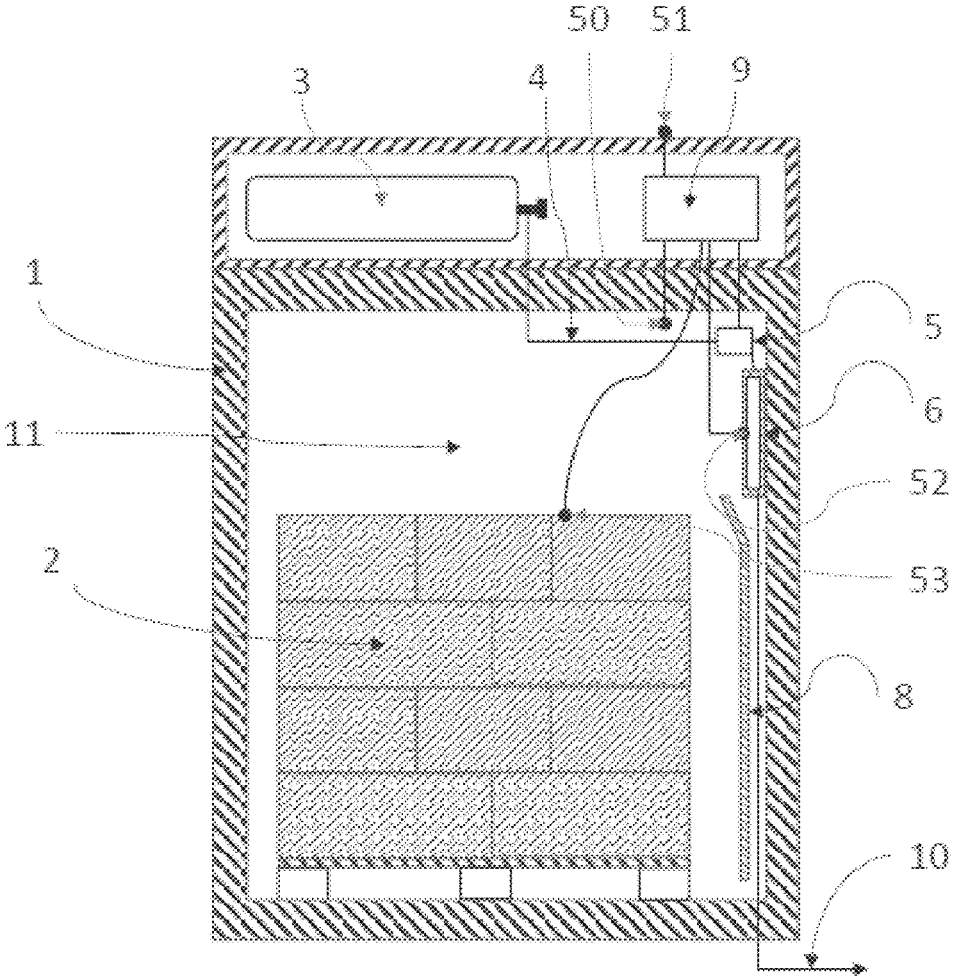
FIG. 8 is a cross-sectional front view of an embodiment of the refrigeration system, illustrating a configuration of the control system.

Referring to FIG. 8, this shows an embodiment that is provided with a controller 9, which allows the user to turn the refrigeration system on and off, and has a means to set a target internal temperature. In its simplest form, the controller 9 may be connected to at least one temperature sensor 50 and to control valve 5 (and to a power source, which is not shown). When the cargo space temperature as measured by sensor 50 is higher than the set target temperature, the controller commands an opening of the valve 5 to inject liquid $CO_2$ into the expansion section 17 of the heat transfer assembly 6. For example, the valve 5 may be opened for a duration proportional to the difference in temperature between the set target temperature and the measured cargo space temperature. The duration can be achieved with a single opening event of the calculated duration or can be a collection of several shorter events that total the calculated duration. It is to be understood that control systems of greater sophistication and incorporating more complex/sophisticated sensor systems may also be utilised. Furthermore, a computer or computer system (which may be integrated with or separate from the controller) may be provided for controlling the controller.

To prevent an over-accumulation of carbon dioxide snow within the expansion chamber 18, it may be desirable to measure at least one location 52 on the surface of the heat transfer assembly 6. The control approach above described can be modified to temporarily interrupt "injections" if the heat transfer assembly wall temperature is below a set threshold that may be set automatically, for example, at 20 to 40° C. below the target temperature.

Additional temperature measurements can be made for the purpose of providing improved control, such as, for example, the temperature external to the container 51 and the load temperature 53.

Temperatures 50, 51, 52 and 53 can be stored on the controller 9 as records that can be accessed and/or monitored by the owner or leaser of the container through a variety of possible means including automatic wireless transmission of the information.

It is contemplated that the controller can be equipped with various other features including:

(i) A display to show the current temperature, the set temperature and the status of the container (on or not) and other information that might be useful for the operation of the container, such as the battery charge level, cooling status and the container $CO_2$ level. Alternatively the controller may broadcast such information such that it can be received or accessed by an external device;

(ii) One or more buttons to set the target temperature, or an alternative means to wirelessly set the internal target temperature with an external device;

(iii) An infrared sensor to monitor the load temperature without a wire;

(iv) One or more buttons to turn the cooling on and off for the container;

(v) A door interlock such that the cooling unit does not operate while the door is opened;

(vi) A means of storing and retrieving digital information (such as via a SD card or via wireless access);

(vii) A $CO_2$ sensor to monitor the environmental $CO_2$ level outside the container;

(viii) A humidity sensor to monitor the humidity in the cargo space;

(ix) A pressure sensor to monitor the pressure within the heat transfer assembly;

(x) A GPS location sensor; or (xi) An algorithm to set the target temperature at the load temperature as measured by a temperature sensor.

The invention claimed is:

1. A passive refrigeration apparatus for controlled refrigeration of a product, the refrigeration apparatus comprising:

an insulated container, the container defining a cargo space for receiving a load;

a cylinder for supplying a flow of liquid carbon dioxide ($CO_2$);

a control valve, in fluid communication with the cylinder, via a fluid pipe;

a controller, adapted to activate and deactivate the control valve, to control the flow of liquid $CO_2$;

a heat transfer assembly, disposed within the container, and in fluid communication with the control valve; and an exhaust fluid line in fluid communication with the heat transfer assembly;

wherein the heat transfer assembly comprises;

an expansion section, in fluid communication with the control valve, and for receiving the flow of liquid $CO_2$; and an expansion chamber, the expansion chamber bounded by at least one heat transfer surface, the at least one heat transfer surface in thermal contact with the cargo space;

wherein the expansion section is adapted to allow a vaporization of the liquid $CO_2$ into the expansion chamber in order to create a mixture of carbon dioxide snow and $CO_2$ gas within the expansion chamber, thereby cooling the cargo space via the at least one heat transfer surface, and wherein the $CO_2$ gas may be exhausted through the exhaust fluid line; and wherein the heat transfer assembly additionally comprises at least one bluff body, disposed within the expansion chamber and proximate to the expansion section, wherein the at least one bluff body facilitates generation of turbulence within the expansion chamber, in order to facilitate creation and accumulation of carbon dioxide snow.

2. The apparatus of claim 1, wherein the apparatus additionally comprises a sensor for measuring a measured parameter within the cargo space or outside of the cargo space, wherein the sensor is in communication with the controller, and wherein the controller activates or deactivates the control valve in response to the measured parameter.

3. The apparatus of claim 2, wherein the sensor is a temperature sensor located within the cargo space, and wherein the measured parameter is an internal temperature of the of the cargo space, and wherein the controller activates or deactivates the control valve in order to control the internal temperature of the cargo space.

4. The apparatus of claim 2, wherein the sensor is a pressure sensor, and the measured parameter is pressure.

5. The apparatus of claim 2, wherein the sensor is a humidity sensor, and the measured parameter is humidity.

6. The apparatus of claim 2, wherein the sensor is a carbon dioxide sensor, and the measured parameter is carbon dioxide level or concentration within the cargo space.

7. The apparatus of claim 1, wherein the heat transfer assembly additionally comprises a filter for preventing carbon dioxide snow from entering the exhaust fluid line.

8. The apparatus of claim 1, wherein the heat transfer assembly additionally comprises one or more ridges disposed within the expansion chamber, and configured to facilitate accumulation of carbon dioxide snow.

9. The apparatus of claim 1, wherein the heat transfer assembly additionally comprises a mesh structure disposed within the expansion chamber, and configured to facilitate accumulation of carbon dioxide snow.

10. The apparatus of claim 1, wherein the container additionally comprises a door, and wherein the container is adapted to receive one or more pallet-sized loads.

11. The apparatus of claim 1, additionally comprising an exhaust manifold configured between the heat transfer assembly and the exhaust fluid line, and in fluid communication with the heat transfer assembly and the exhaust fluid line, wherein the exhaust manifold permits passage of the $CO_2$ gas therethrough and is in thermal contact with the cargo space.

12. The apparatus of claim 11, wherein the exhaust manifold is configured in a serpentine configuration.

13. The apparatus of claim 1, wherein the heat transfer assembly is provided with a plurality of convective fins for facilitating heat transfer between the cargo space and the heat transfer assembly.

14. The apparatus of claim 1, wherein the heat transfer assembly is generally disposed in an upper portion of the cargo space.

15. The apparatus of claim 1, additionally comprising a barrier, disposed within the cargo space, for keeping the load from coming into contact with the heat transfer assembly.

16. The apparatus of claim 1, additionally comprising a barrier, disposed within the cargo space, the barrier configured to facilitate convective flow of cold air proximate the heat transfer assembly to a floor of the cargo space.

17. The apparatus of claim 1, provided with one or more additional heat transfer assemblies.

* * * * *